US006241170B1

(12) United States Patent
St. Clair

(10) Patent No.: US 6,241,170 B1
(45) Date of Patent: Jun. 5, 2001

(54) INDUSTRIAL SHREDDERS AND NOVEL COMPONENTS THEREFOR

(75) Inventor: H. Denny St. Clair, Bay City, MI (US)

(73) Assignee: CD Systems Inc., Bay City, MI (US)

( * ) Notice: Subject to any disclaimer, the term of this patent is extended or adjusted under 35 U.S.C. 154(b) by 0 days.

(21) Appl. No.: 09/489,166

(22) Filed: Jan. 21, 2000

(51) Int. Cl.[7] ..... B02C 18/16
(52) U.S. Cl. ..... 241/167; 241/166; 241/236
(58) Field of Search ..... 241/236, 166, 241/167, 295, 294

(56) References Cited

U.S. PATENT DOCUMENTS 5,285,973 2/1994 Goforth et al. .
5,400,978 * 3/1995 Strohmeyer ..... 241/166
5,516,050 5/1996 Yamamoto et al. .
5,609,307 3/1997 Rota .
5,636,801 * 6/1997 Kroger ..... 241/167
5,954,279 * 9/1999 Siegfried et al. ..... 241/166

* cited by examiner

*Primary Examiner*—Rodney A. Butler
(74) *Attorney, Agent, or Firm*—Robert L. McKellar

(57) ABSTRACT

Industrial shredders containing a novel shredding head and novel stripper blades to prevent or reduce the possibility of jamming the shredder during operation. The Industrial shredder requires the use of a stripper blade which is removable and replaceable without the use of tools, or without having to tear down the shredder. The shredders are typically used to reduce industrial solid waste such as cardboard, rubber, metal, plastics, paper, and the like to small particles or pieces.

3 Claims, 8 Drawing Sheets

INDUSTRIAL SHREDDERS AND NOVEL COMPONENTS THEREFOR

The invention disclosed and discussed herein deals with industrial shredders containing a novel shredding head and novel stripper blades to prevent or reduce the possibility of jamming the shredder during operation. The stripper blades do not require that they be affixed to the shredder head in order to carry out their function, and the benefit of being able to remove and replace such stripper blades without the aid of tools, or without having to disassemble the shredder is highly advantageous in that valuable time is saved in the operation of the shredder. The shredders are typically used to reduce industrial solid waste such as cardboard, rubber, metal, plastics, paper, and the like, to small particles or pieces.

BACKGROUND OF THE INVENTION

This invention deals with industrial rotary shredders. Rotary shredders are very well known devices which are used to comminute waste materials for purposes of reducing the bulk of such waste material and/or to more easily facilitate recycling of such materials.

In general, conventional rotary shredding devices are provided with a pair of parallel, horizontally spaced-apart, cutter shafts one or both of which may be mounted on drive shafts, a series of alternating disc-type cutters and spacer elements equally spaced-apart along the shaft axes. The cutter discs on the shafts are interdigitally placed along the shafts. That is, the cutter discs on the shafts are fixed at a position along the shaft axis so that they extend into the space between the cutters on the other shaft, i.e., into the spaces between the cutter discs established by the spacer discs.

The cutter shafts are counter-rotated so that the upper portions of the cutter discs on the two shafts rotate toward each other to force material fed into the device from above, downwardly, between the two shafts where the material is shredded in the nip created by the interdigitized cutter and spacer elements. Reference can be made to FIG. 1 of this specification for a prior art configuration of such a cutting chamber of such a device.

As can be observed from FIG. 1 of this application, prior art rotary shredders are typically provided with a plurality of immovable, or firmly attached finger elements which extend inwardly toward the cutter/spacer discs to strip shredded material from the cutter and spacer discs to thereby prevent such shredded material from wrapping around the cutter shafts and overloading the shaft drives, and hence overloading the driving motors and other apparatii of the device.

One reference that deals with the problems of jamming in the shafts of the rotary shredder is U.S. Pat. No. 5,285,973, issued Feb. 15, 1994 to Goforth, et al, in which a shredder is described which utilizes side support bearings which are affixed to the walls of the cutting chamber and act to support the shaft, while preventing the flow of comminuted material between the cutters and thus preventing wear on the cutter discs. It should be noted that the support bearings, even though providing the needed clearing away of comminuted material, are bolted or otherwise affixed to the apparatus such that the equipment has to be torn down to replace such support bearings.

In another such reference, U.S. Pat. No. 5,516,050, issued May 14, 1996 to Yamamoto, et al, there is shown rows of finger blocks mounted to a frame body of a rotary industrial shredder, laterally parallel to rotating shafts. The fingers are provided to maintain tight clearances between the fingers and the cutters of the rotary shredder. It should be noted that the patentees therein, at column 3, lines 37, et seq. state that the importance of their invention is the opposed series of finger blocks which are mounted to the frame body laterally parallel to the shafts and in opposition to the series of cutter/spacer discs. The finger blocks are mounted between a pair of parallel, vertically separated upper and lower positioning bars, and are rigidly attached to the inside lateral face of the frame body. Thus, the finger bars are rigidly clamped between the two parallel bars, which requires that one of the parallel bars has to be detached before the finger blocks can be moved, removed and/or replaced.

Finally, there is shown in U.S. Pat. No. 5,609,307, which issued on Mar. 11, 1997 to Rota, a shredding apparatus in which there is employed "cleaning sectors" which are fixed to the frame of the apparatus, which cooperate with a slower rolling pair of cooperating rollers having cutting discs. These cleaning sectors provide for a comb-like arrangement to clean between the rotating cutting discs.

Each of these prior art devices provide for cleaning between the cutting discs, but all require that the cleaning devices be fixed to the walls or frame of the device, requiring extended down time in order to remove and replace worn or defective parts.

THE INVENTION

The instant invention thus deals with a novel stripping blade useful in rotary shredder cutting heads, novel rotary shredder cutting heads containing such stripping blades, and novel rotary shredders utilizing such shredder heads therein wherein the stripping blades are not fixed within the cutting chamber, but are allowed to float freely therein supported only by specific spacer discs, the adjacent cutter discs, and the lateral edge of the lower casing of the housing which contains such rotary shredder cutting heads.

Thus there is provided in this invention one embodiment which is a novel stripper blade, which blade comprises a solid, unitary, essentially flat body having a flat top, an outwardly arcuate bottom surface and a front. In addition, the stripper blade comprises an outwardly arcuate back surface contiguous with the arcuate bottom surface wherein the back surface has an upper portion. The front surface has an inwardly arcuate surface intended to extend around a circular spacer in an arc of at least 190 degrees to an arc of not greater than about 260 degrees. The arcuate surface has a lower leading edge and an upper trailing edge, wherein the leading edge and the trailing edge are cutting edges. The outwardly arcuate back surface has a support projection protruding from the upper portion.

In another embodiment of the invention, there is a shredder head comprising a housing and two shredding rollers, each shredding roller comprising a drive shaft rotatably, horizontally mounted in the housing and spaced apart and parallel to the other drive shaft. The drive shafts are mounted such that all of the ends of the drive shafts extend through a cartridge carrier assembly and outside of the housing. Each drive shaft has a drive end and an idle end. One drive end extends out one end of the housing, and the other drive end extends out of the opposite end of the housing so that a drive motor can be attached to each of the drive shafts.

There is a series of spaced, cutter disc blades disposed along each drive shaft, and the rollers cooperate with each other such that each disc blade on one roller is interdigitally spaced between disc blades on the opposing roller to provide shredding interfaces. The cutter discs are mounted on the drive shafts such that they rotate in the same direction as the rotation of the drive shaft upon which the discs are mounted.

There is a housing defined by an upper and a lower casing, the lower casing having an interior surface conforming at least to allow the drive shafts and the cutter discs to rotate in it, and the lower casing also has a discharge opening.

The upper casing has an interior surface also conforming at least to allow the drive shafts and the cutter discs to rotate in it. The upper casing also has an infeed opening, wherein the upper casing and the lower casing are capable of fitting together to enclose the cutting discs and provide a cutting chamber.

In addition, there is a series of circular spacer discs disposed along each drive shaft and between each cutting disc, wherein the spacer discs are mounted on the drive shafts such that they rotate in the same direction as the rotation of the drive shaft upon which the spacer discs are mounted.

There is a series of stripper blades. Each stripper blade comprises a solid, unitary essentially flat body having a flat top, an outwardly arcuate bottom surface, a front, and an outwardly arcuate back surface contiguous with the arcuate bottom surface. The back surface has an upper portion, and the front surface has an inwardly arcuate surface intended to extend around the circular spacer in an arc of at least 190 degrees to an arc of not greater than about 260 degrees. The arcuate surface has a lower leading edge and an upper trailing edge and the leading edge and the trailing edge each have cutting edges. The outwardly arcuate back surface has a support projection protruding from the upper portion and near the top thereof. Each stripper blade is mounted between the cutter discs such that the front inwardly arcuate surface rests on a spacer disc, and the support projection of each stripper blade rests on a supporting edge provided by the lower casing.

The drive shafts are peripherally, dynamically sealed at their ends by a sealing mechanism. The upper casing and the lower casing also have a sealing capability, each with the other at their mating interfaces, and around the drive shafts' carrying cartridge assemblies.

DETAILED DESCRIPTION OF THE DRAWINGS

Figure 1:
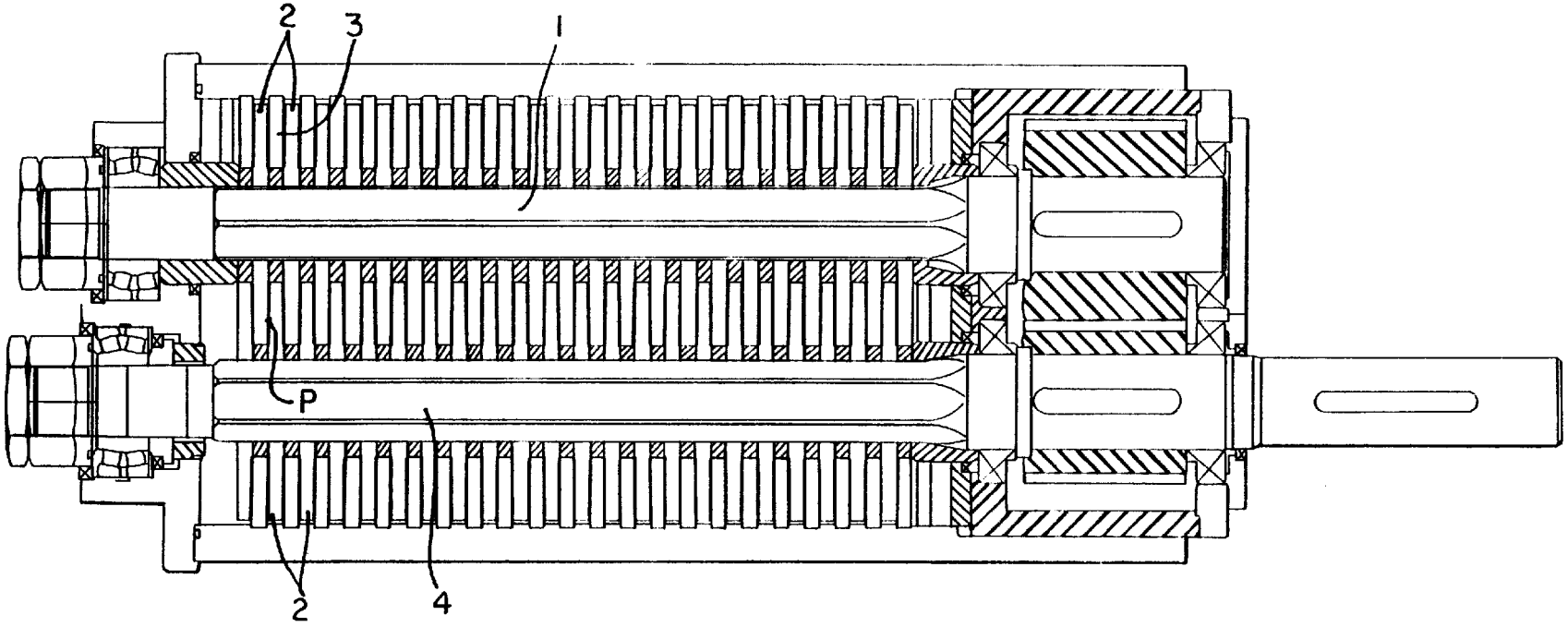
FIG. 1 is a conventional, prior art shredder head assembly, with a full view from the top, with the top cover removed.

FIG. 1 is a full top view of a conventional shredder head in which there is shown interspersed with each other along a drive shaft 1, cutter blades 2, and spacer bars 3, wherein the adjacent cutter blades 2 are separated by the spacer bars 3 and the cutter blades 2 which are mounted on the opposite drive shaft 4 are overlapped as exemplified at point P to provide multiple shearing and/or cutting interfaces.

Figure 2:
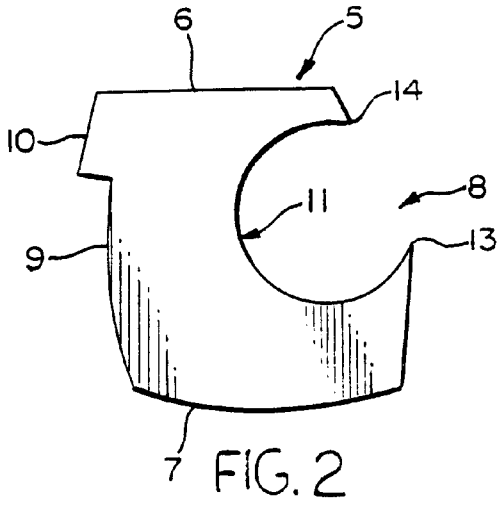
FIG. 2 is a full side view of a stripper blade of this invention.
Figure 3:
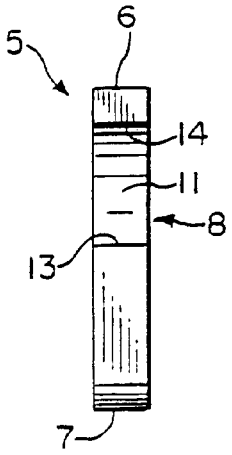
FIG. 3 is a full front view of the stripper blade of FIG. 2.
Figure 4:
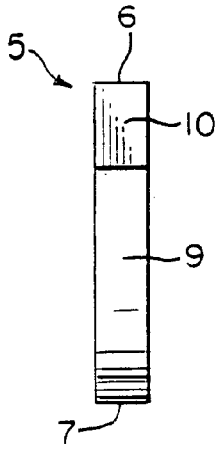
FIG. 4 is a full back view of the stripper blade of FIG. 2.

Turning to the instant invention, there is shown in FIG. 2, a full side view of a stripper blade 5 of this invention, in FIG. 3, there is shown a full front view of the stripper blade 5, and in FIG. 4, there is shown a full back view of the stripper blade 5.

Each stripper blade 5 is a solid, unitary essentially flat body having a flat top 6, an outwardly arcuate bottom surface 7, a front 8, and an outwardly arcuate back surface 9 contiguous with the arcuate bottom surface 7. The outwardly arcuate back surface 9 has an upper portion 10 at the top thereof, which projects outwardly from the back surface 9, the significance of which will be discussed infra.

The front surface 8 has an inwardly arcuate surface 11 intended to extend around a circular spacer 12 in an arc of at least 190 degrees to an arc of not greater than about 260 degrees. The circular spacer 12, and its significance and relationship to the stripper blade 5 is discussed infra.

The inwardly arcuate surface 11 has a lower leading edge 13, and an upper trailing edge 14. Both of these edges are cutting edges. It is intended that the edges 13 and 14 are enabled to cut the waste material being processed so as to assist this operation in conjunction with the cutting blades 16. The existence of the edges 13 and 14 as cutting edges contributes to a process that does not have the jam capability of prior art shredders having blunt surfaces or rounded surfaces.

As are the majority of the metal parts of the shredder described herein, the stripper blades 5 are made of hardened metal in order to withstand the rigors of the processing of waste materials.

The actual size of the stripper blades 5 depends on the size of the shredder that they are to be used in. Nominally, the stripper blades 5 are be on the order of about 3 inches in diameter to about 10 inches in diameter, and the width or thickness of such stripper blades 5 is on the order of about 0.5 to about 1.25 inches.

Figure 5:
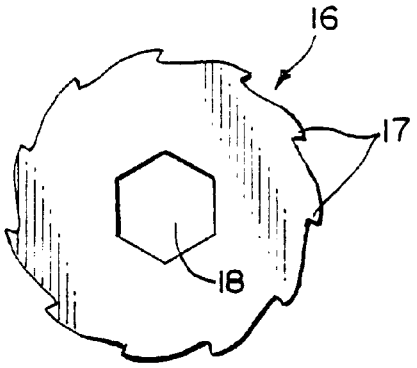
FIG. 5 is a full side view of a cutting disc of this invention.

Turning now to FIG. 5, there is shown a full side view of a cutter blade 16 of this invention wherein, in detail, there is shown the blade 16, the cutting teeth 17, and the hexagonal opening 18. The hexagonal opening 18 is intended to be an opening such that a hexagonal drive shaft 25 for the device can be inserted therein. Such hexagonal openings 18 used in conjunction with the hexagonal drive shafts 25 are known in the art and the configuration of a hexagon is intended to allow a positive grip of the cutter blade 16 on the drive shaft 25, which drive shaft 25 will be described in detail infra. The number and placement of the teeth 17 on the cutter blade 16 depends on the waste material to be comminuted and the size of the shredder they are intended to be used in. Nominally, about 10 to 12 cutter teeth 17 are preferred for most applications, but as few as two such cutter teeth 17 can be used and as many as about 20 such cutter teeth 17 can be used.

Figure 6:
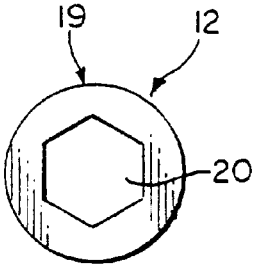
FIG. 6 is a full side view of a circular spacer of this invention.

Shown in FIG. 6 is a circular spacer 12 which is used in conjunction with the stripper blade 5. The outside diameter 19 of the circular spacer is configured such that the circular spacer 12 fits snugly into the circular opening created by the inwardly arcuate surface 11 of the stripper blade 5. By snugly, it is meant that the circular spacer 12 is machined such that the stripper blade 5 will rotate around the circular spacer 12 with the circular spacer outside diameter (surface) 19 acting as a smooth surface bearing. As will be shown and discussed infra, the circular spacer 12, with hexagonal opening 20 is intended to be configured such that a drive shaft can be inserted in the hexagonal opening 20 to provide a positive grip on the circular spacer 12 such that the circular spacer 12 will rotate with the drive shaft 25.

Figure 7:
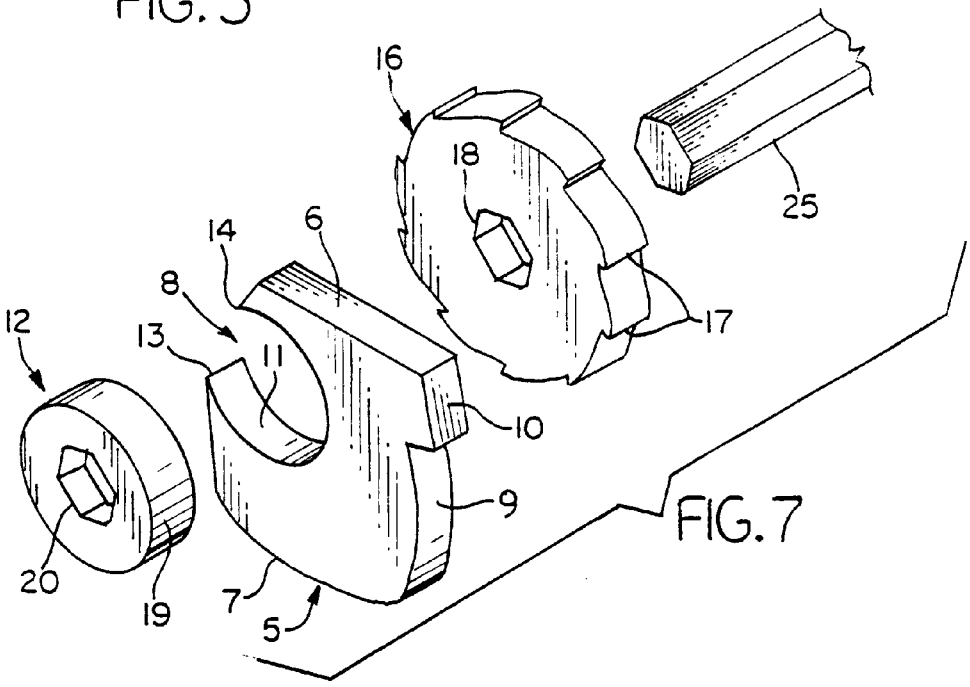
FIG. 7 is an exploded view of a drive shaft, a cutting disc, a stripper blade, and a circular spacer in the arrangement within the invention.

Thus, FIG. 7 shows an exploded view of the combination of the drive shaft 25, cutting blade 16, stripper blade 5, and the circular spacer 12. As can be observed, the circular spacer 12 fits into the opening created by the surface 11, and that combination sits adjacent the cutting blade 16, the circular spacer 12 and the cutter blade 16 being supported by the drive shaft 25, and the stripper blade 5 being supported in part by the circular spacer 12. The entirety of the support for the stripper blade 5 will be more fully discussed infra.

Both drive shafts 24 of the shredder 56 should be as identical to each other as is practicable using standard machining methods, and should be interchangeable with the shredder bearing cartridges which carry the opposing shafts. The shredder cutting box, or chamber is constructed such that it includes upper 40 and lower 41 rectangular frame halves, bolted together in a clamshell fashion. When the upper clamshell half 40 is unbolted and removed, the shaft/cartridge assembly will be exposed for easy lifting via specially-constructed lifting bars. A principal feature of this construction is that of inherent rigidity that is afforded by the solid clamshell frames 40 and 41 which are not bolted at the corners, as is the case in conventional cutting frame construction.

The actual size of the cutting blades 16 depends on the size of the shredder that they are to be used in. Nominally, the cutter blades 16 are on the order of about 8 inches in diameter to about 12 inches in diameter, and the width or thickness of such cutter blades 16 is on the order of about 0.5 to about 1.25 inches. As with the stripper blades 5, the cutter blades 16 of this invention are manufactured from hardened metal.

Figure 8:
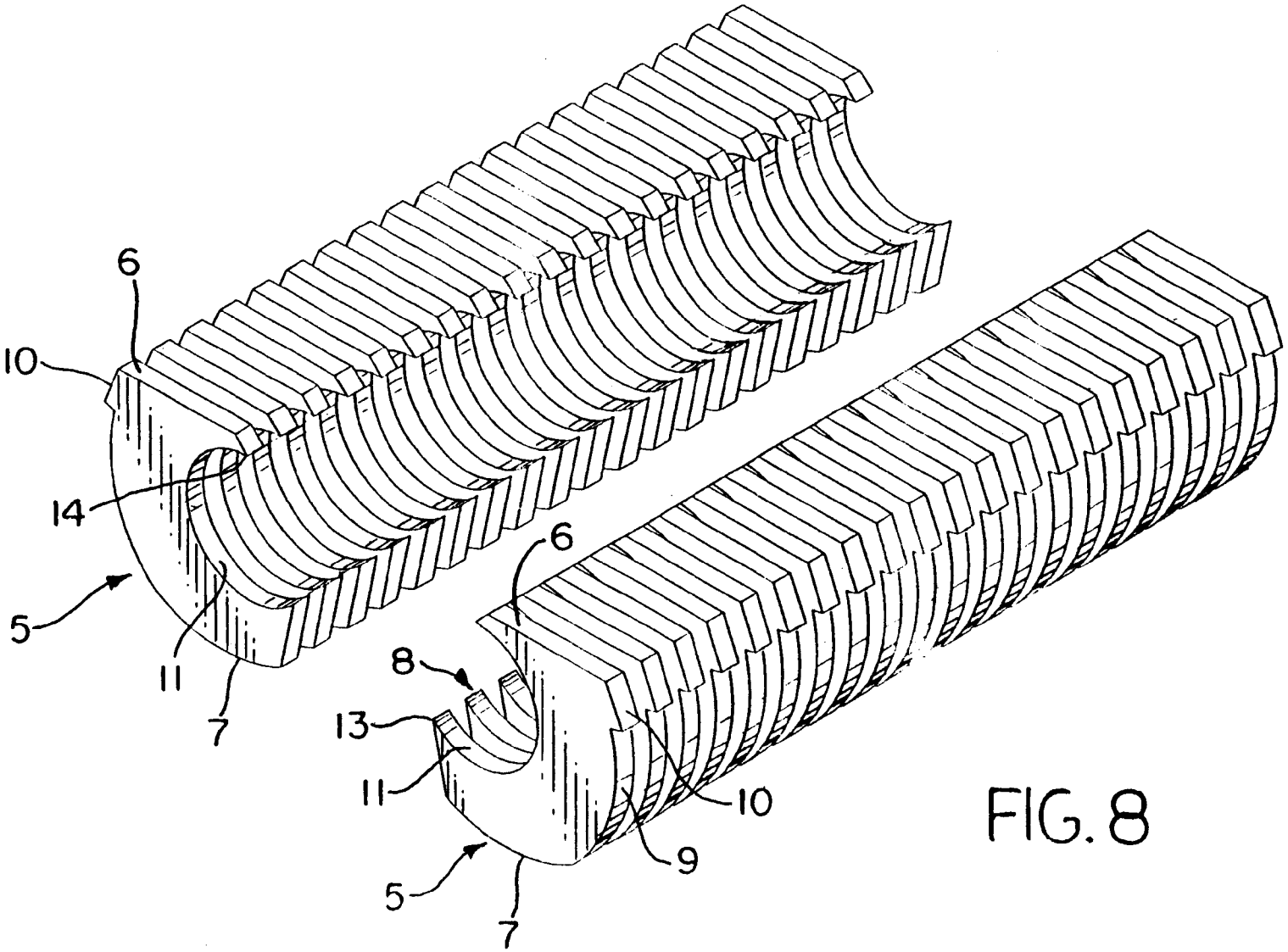
FIG. 8 is a view in perspective of two rows each of several is stripper blades as they would appear on a drive shaft.

FIG. 8 shows in perspective, two opposing rows of stripper blades 5 as they would appear in the cutter head 30 to be described infra, wherein like numbers have like meanings as used herein.

Figure 9:
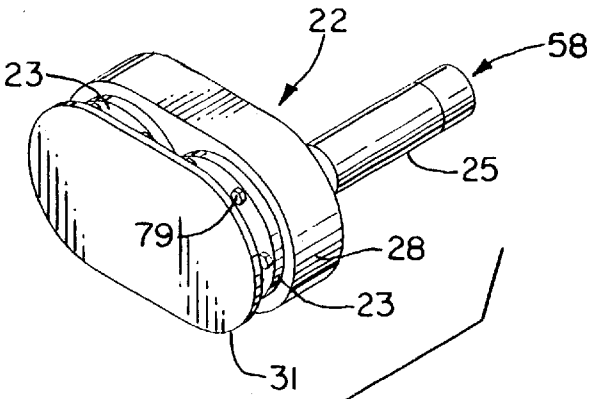
FIG. 9 is a view in perspective of the peripheral dynamic seals for the ends of the drive shaft without the complete drive shafts and without the motors.
Figure 9:
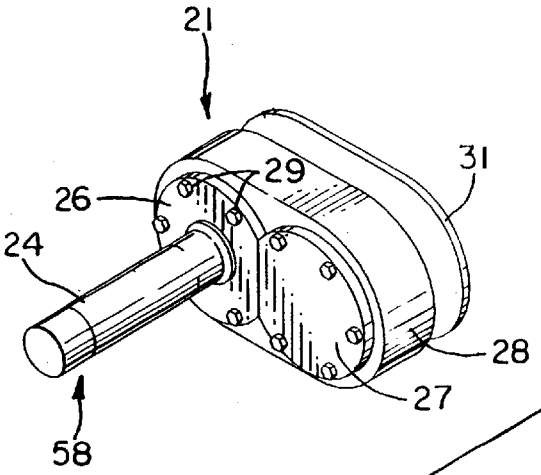

Turning now to FIG. 9, which is a view in perspective of the cartridge carrier assemblies 21 and 22 for the ends of the drive shafts 24 and 25 without the complete drive shafts and without the motors in order to bring clarity to the Figures.

Figure 16:
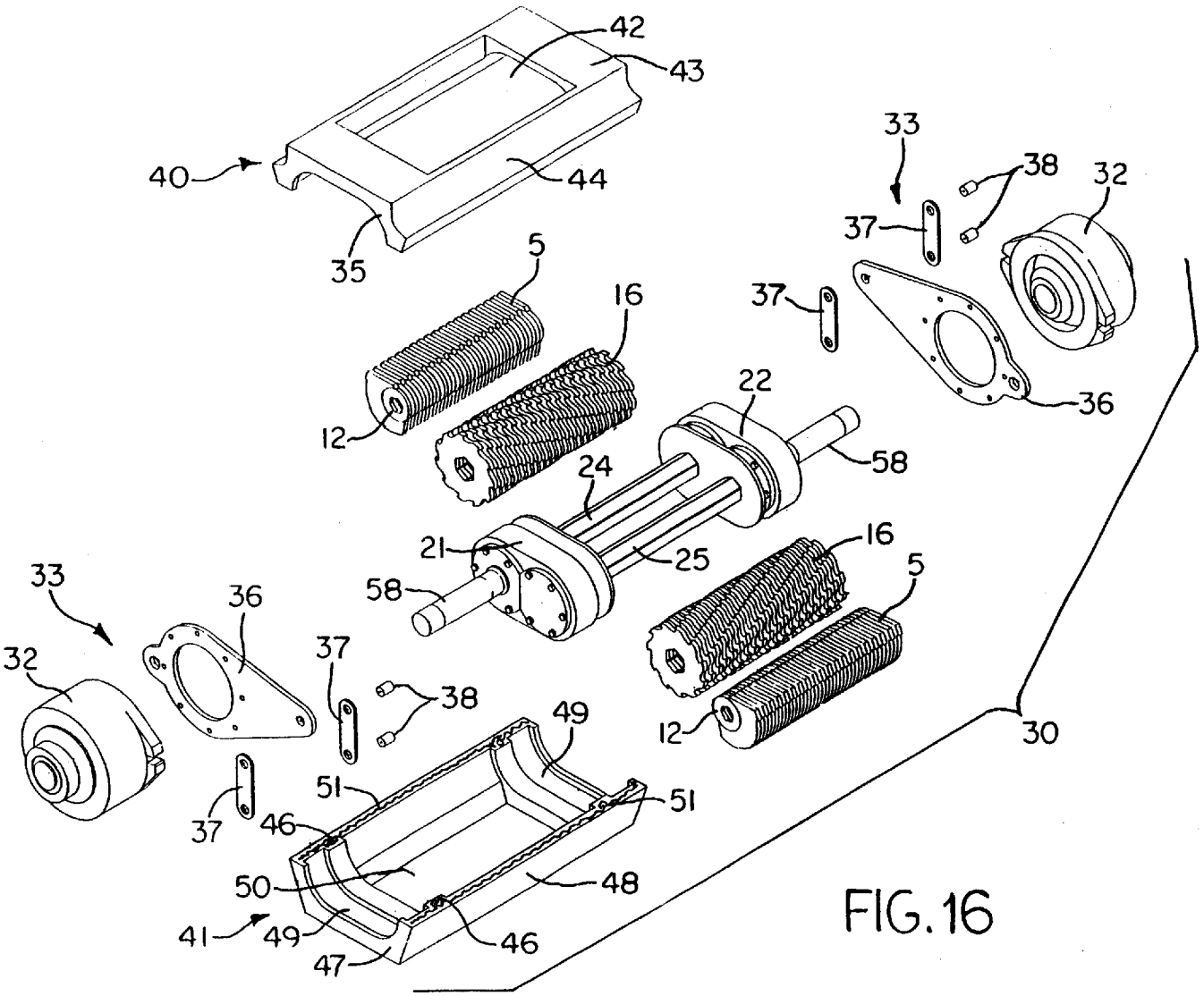
FIG. 16 is an exploded view of the components of the cutting chamber and associated torque apparatii and the motors associated therewith.
Figure 17:
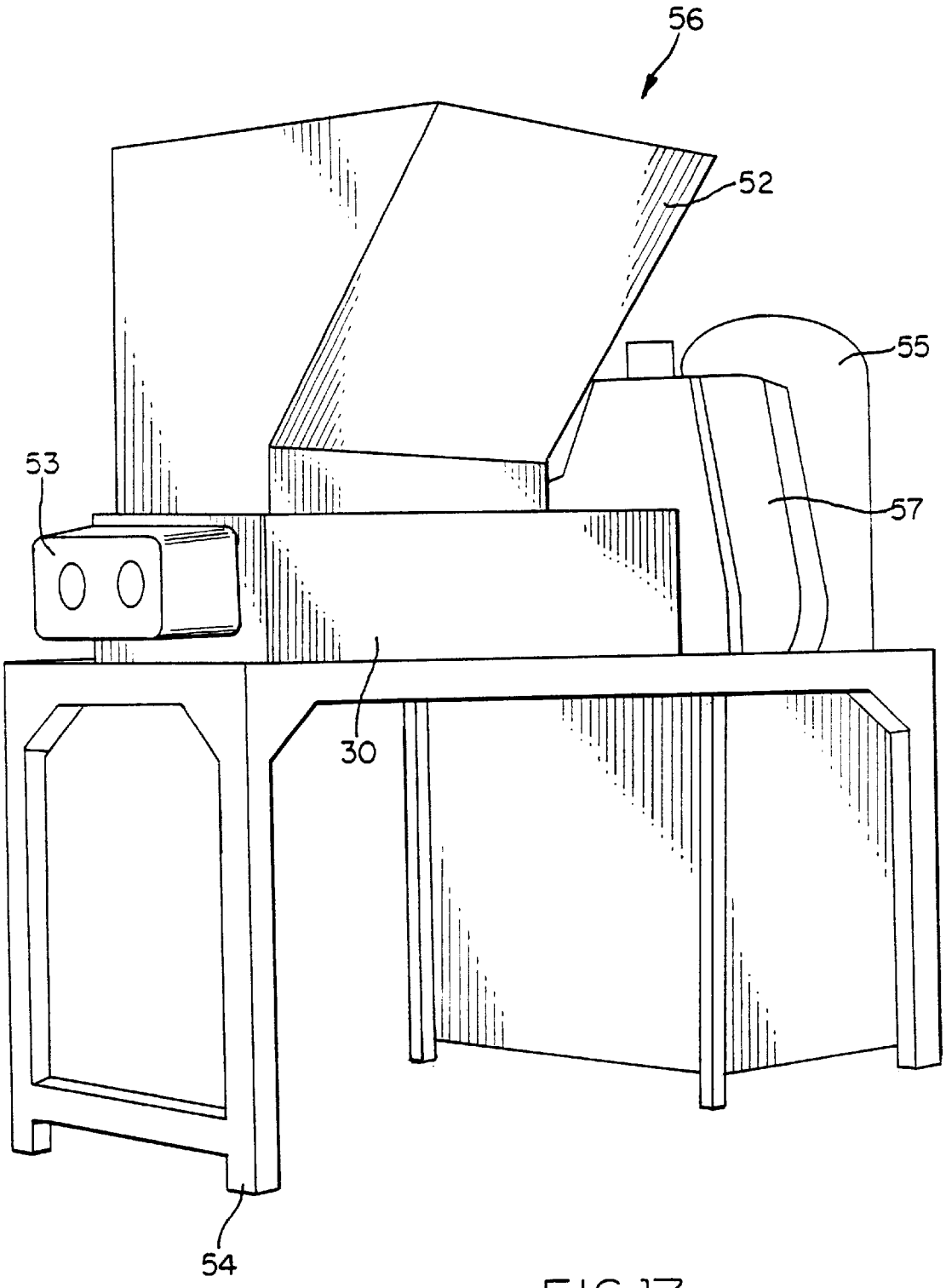
FIG. 17 is a full view in perspective of one model of an industrial shredder of this invention.

It should be noted by those skilled in the art that preferred for this invention are shredders that are useful for disposing of biological waste, and therefore, there is a need for a sealed shredder head 30 (FIG. 16). Part of the sealing is in the housing which will be described infra, but another part of the sealing is at the drive shaft 24 and 25 ends.

Thus shown in FIG. 9 are cartridge carriers seals 21 and 22. Cartridge carrier 22 shows the inside cover plates 23 for the drive shafts 24 and 25. Also shown are the support plates 31 for the drive shafts 24 and 25.

Figure 10:
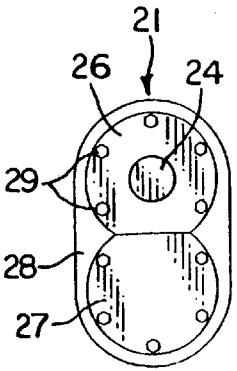
FIG. 10 is an outside end view of one of the cartridge carriers of this invention.

The cartridge carriers 21 and 22 are identical in configuration and each are enclosed by covers 26 and 27. The cartridge carriers 21 and 22 carry the bearings for the drive shafts 24 and 25, which bearings are not shown herein, but are conventional bearings, known in the art. Cover 26 is designed to accommodate the drive shafts 24 and 25 and shown in particular is cover 26, for drive shaft 24. The cover 26 and the cover 27 each have a gasket type of inner seal between the covers and the wall of the cartridge carrier 21. Cover 27 is shown as a full end cover for the cartridge carrier 21, while 28 is a peripheral dynamic seal which has a rubber seal (not shown, but is a conventional O-ring type of seal) inside the cover to provide a positive seal around the cartridge carrier 21. FIG. 10 is a full end view of the cartridge carrier 21, showing the cover 26, the cover 27, the peripheral dynamic seal 28, and the drive shaft 24. Also shown are a multiplicity of fasteners 29 used to fasten the covers 26 and 27 to the dynamic seal 21.

Figure 11:
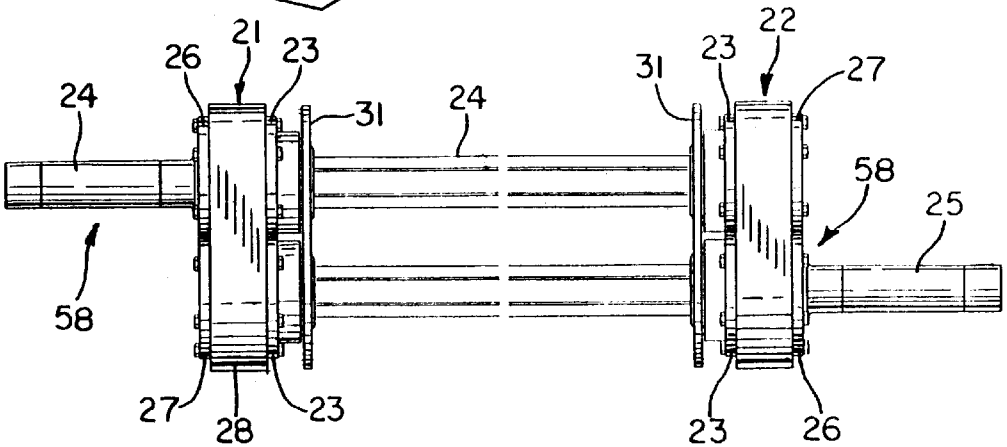
FIG. 11 is a top view of the cartridge carriers and the drive shafts of the shredder head of this invention, wherein the drive shafts are broken at about the middle thereof.

FIG. 11 is a full top view of the cartridge carriers 21 and 22 configured with the drive shafts 24 and 25, to show the arrangement of the same in the cutter head 30 (FIG. 16).

Figure 12:
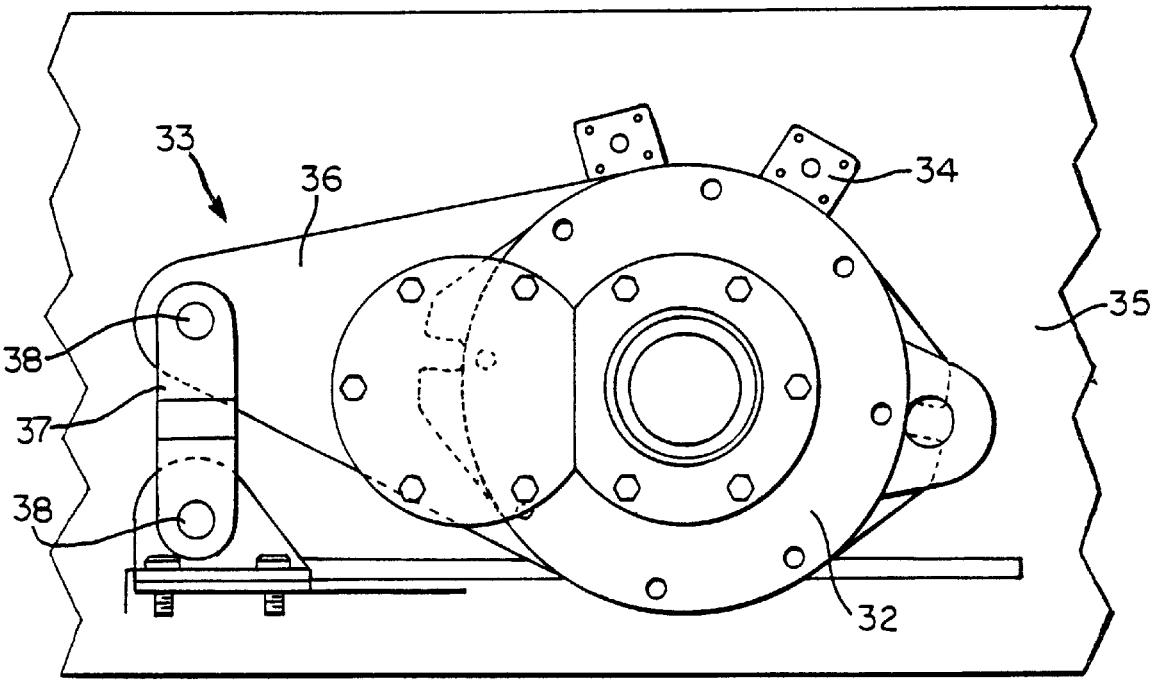
FIG. 12 is an end view of the motor mounted on the drive shaft, and associated with the torque assembly.

Turning now to FIG. 12 which is a full end view of a motor 32 mounted on the drive shaft 24, and associated with the torque assembly 33.

As can be observed from FIG. 16, there are two drive shafts 24 and 25 in the cutter head 30, and each drive shaft is driven by a motor 32. As can be noted, the drive ends 34 of the drive shafts 24 and 25 extend outside of opposite ends of the shredder head 30. A hydraulic motor 32 is mounted on each of such drive ends 34, and a torque assembly 33 is connected to the motors 32 to control torque during operation of the motors, especially at start up of the equipment or in a situation where the shredder becomes jammed or is slowed in some manner.

Figure 13:
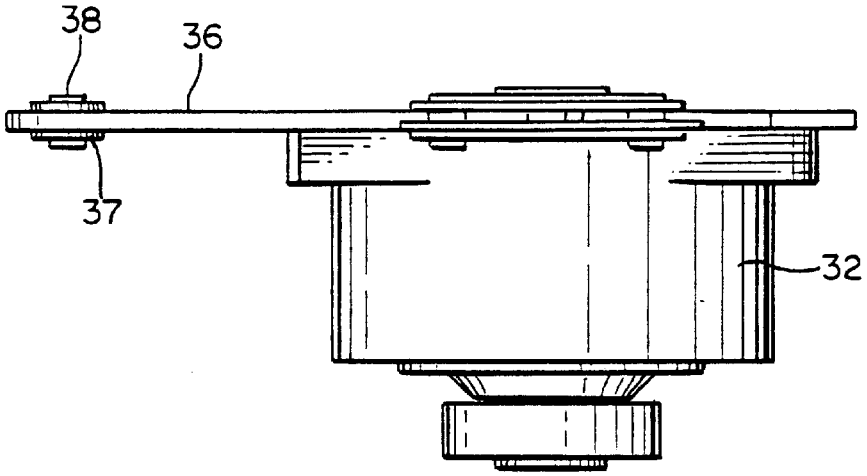
FIG. 13 is a top view of the apparatus of FIG. 12.

Thus, there is shown in FIGS. 12 and 13, the motor 32, its attachment 34 to the wall 35 of the casing 39 (shown in FIGS. 14 and 15), and the torque assembly 33. Comprising the torque assembly 33 are the torque arm 36, the torque link 37, and torque pins 38, which apparatus also is used in conjunction with fluid coupling which is not shown, as such couplings are common and well-known in the art.

Figure 14:
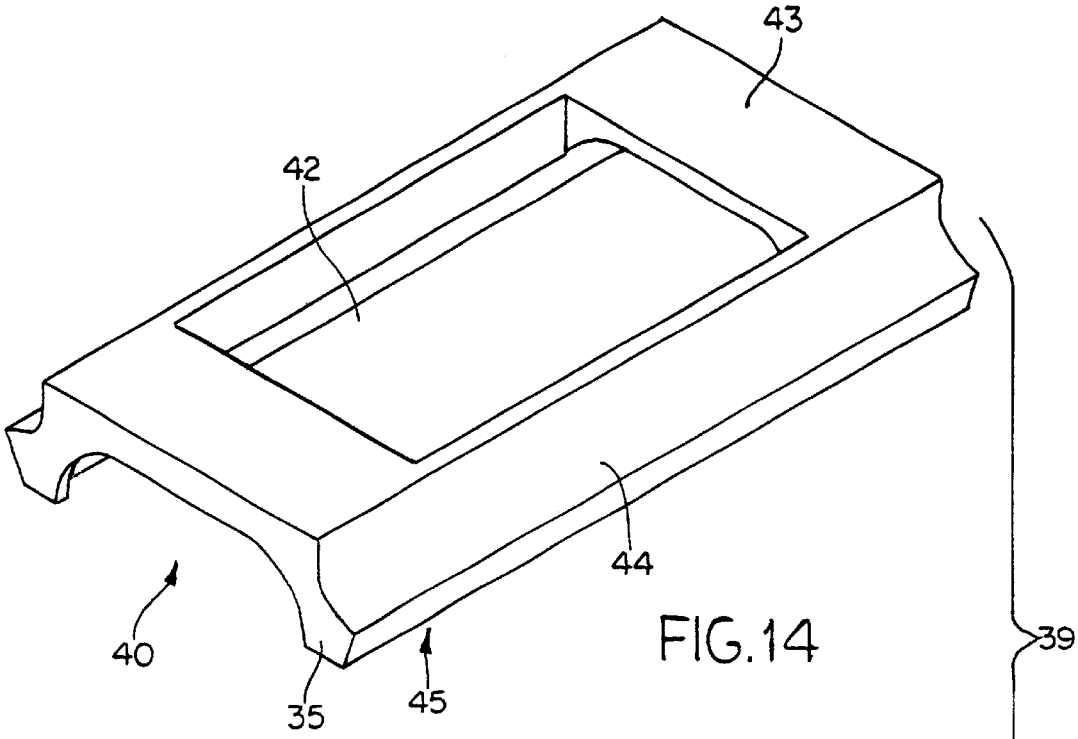
FIG. 14 is a view in perspective of the upper casing of the cutting chamber.
Figure 15:
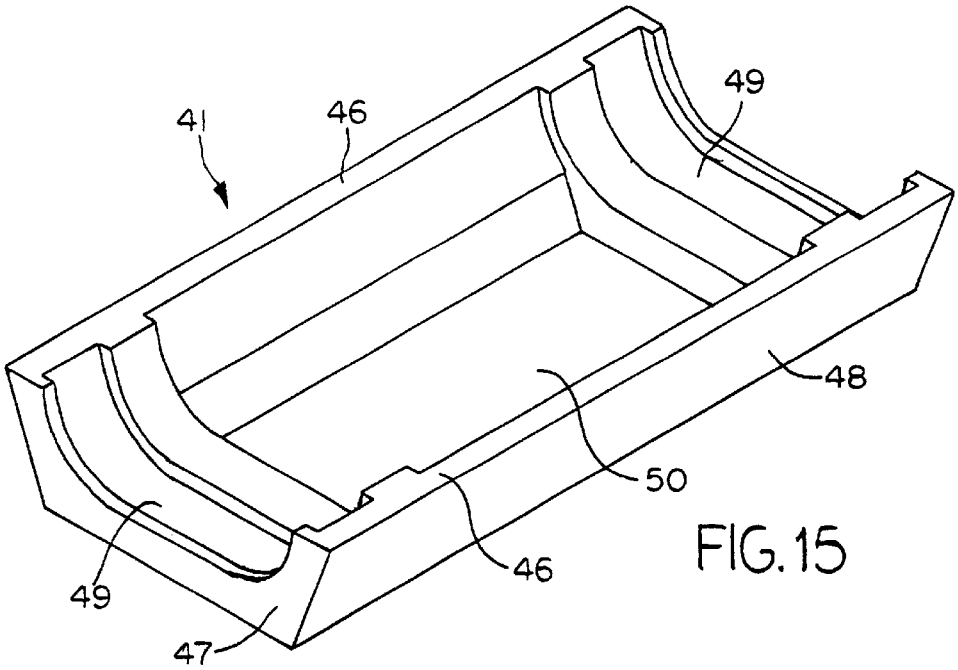
FIG. 15 is a view in perspective of the lower casing of the cutting chamber.

Turning now to FIGS. 14 and 15, which together comprise the casing 39 for the cutter head 30, it can be observed that FIG. 14 shows the upper casing 40, and FIG. 15 shows the lower casing 15.

Upper casing 40, has an infeed opening 42 in the top 43, end walls 35 and side walls 44. The bottom edges 45 of the upper casing 40 are flat such they will conform essentially to the flat surfaces 46 of the lower casing 41.

Lower casing 41 is configured essentially the same as the upper casing 40. There is shown end walls 47, side walls 48, flat surfaces 46, a discharge opening 50 for discharging the comminuted waste to a container or the like, and the cradles 49 for holding cartridge carriers 21 and 22.

As indicated supra, the design of the lower casing 41 is critical as far as the flat surfaces 46 are concerned, in that, the flat surfaces 46 are required in order to support the back of the stripper blades 5. One will recall from the discussion supra, that the stripper blades 5 have a projection 10 at the upper end of the back surface 9. When in place in the shredder head 30 assembly, this projection 10 rests on the flat surface 46, which configuration supports the back of the stripper blade 5, and prevents the stripper blade 5 from moving in an outwardly, downwardly direction during the operation of the shredder.

It should be noted at this point that the stripper blades 5 are not mounted in a fixed manner in the cutter head 30, but instead are free floating to the extent that they are only held in place by the support (flat surface) at the back, described just supra, the adjacent cutter blades 16, and the circular spacer 12 essentially holds the stripper blade 5 in place at the front. Otherwise, the stripper blades 5 can be picked up by the back, moved towards the center of the shredder head 30, and then be lifted out of the shredder head 30 in conjunction with lifting the shaft/cartridge assemblies. Similarly, the stripper blade 5 that is removed in this manner can be replaced by using the reverse maneuver, that is, dropping the stripper blade 5 onto the circular spacer 12 such that the opening created by surface 11 mates with the outside surface of the circular spacer 12, and then, moving the back 9 of the stripper blade 5 down to the flat surface 46, where it rests and is supported. Note that this can be achieved without the use of any tools, and further note that it can be achieved without tearing down the shredder head 30. The only requirement is that the shredder head 30 be shut down to prevent an accident. Such stripper blade arrangements are not shown in the prior art.

Turning now to FIG. 16, wherein there is shown an exploded view, of another embodiment of this invention, the shredder head 30. There is shown the upper casing 40, with its infeed opening 42 through the top 43, end walls 35, and side walls 44.

Further shown is the lower casing 41, with discharge opening 50, end walls 47, side walls 48, flat surfaces 46, and cradles 49 for the cartridge carriers 21 and 22. Also shown on the flat surfaces 46 is a sealing material 51 which enables the upper casing 40 and the lower casing 41 to be sealed together to form the housing for the shredder head 30.

The shredding rollers of the shredding head 30 are comprised of the drive shafts 24 and 25, which drive shafts 24 and 25 are horizontally mounted in the housing and are supported by the cartridge carriers 21 and 22 respectively. The cutting blades 16 and the circular spacers 12 are disposed on the respective drive shafts 24 and 25, in an alternate fashion on the same drive shaft, such that the circular spacers 12 of one such shredding roller are aligned opposite the cutting blades 16 on the opposite shredding roller, and such that the cutter blades 16 of one shredding roller overlap at the shearing interface with cutter blades 16 of the opposite shredding roller. Further, the stripper blades 5 are aligned with each of the circular spacers 12, as described in detail supra. Finally, motors 32, and associated torque assemblies 33 are mounted on the drive ends 58 of each of the drive shafts 24 and 25.

Yet another embodiment of this invention is the novel shredder utilizing the novel shredder head 30, which in turn utilizes the novel stripper blade 5 of this invention.

There is shown in FIG. 16, a full size industrial shredder 56, in which there is shown the shredding head 30 of this invention, a feed hopper 52, some control box 53 for the shredding head 30, a support stand 54 for the shredding head 30, a shroud 55 covering the drive mechanism for the shredding head 30, reduction equipment 57 from the drive mechanism to the mechanical motors of the shredder. The shredder 56 also requires a power source for the drive mechanism, which power source is not shown herein, as it is conventional in the art.

Other equipment that supports the operation of the shredder is also contemplated within the scope of this invention, such as, for example, electrical, thermal, and mechanical controls, computerization, lighting, collection apparatii, fluid coupling assemblies, drive belts, attendant pulleys and other drive shafts, reverse and forward capability, electrical, thermal, and mechanical safety, protective, and overload devices, attendant air devices, attendant fume hoods, and the like.

What is claimed is:

1. A shredder head comprising:

A. a housing;

B. two shredding rollers, each comprising a drive shaft rotatably, horizontally mounted in said housing and spaced-apart and parallel to each other, wherein one end of each drive shaft extends through a cartridge carrier assembly and outside of the housing, and wherein each drive shaft has a drive end and an idle end, the drive ends each being located on opposite ends of the housing;

C. a series of spaced-apart, cutter disc blades disposed along each said drive shaft, the rollers cooperating with each other such that each disc blade on one roller is interdigitally spaced between disc blades on the opposing roller to provide shredding interfaces, said cutter discs being mounted on said drive shafts such that they rotate in the same direction as the rotation of the drive shaft upon which the discs are mounted;

the housing defined by an upper and a lower casing:

i. the lower casing having an interior surface conforming at least to allow the drive shafts and the cutter discs to rotate therein, said lower casing having a discharge opening;

ii. the upper casing having an interior surface conforming at least to allow the drive shafts and the cutter discs to rotate therein, said upper casing having an infeed opening, said upper casing and said lower casing being capable of fitting together to enclose the cutting discs and provide a cutting chamber;

D. a series of circular spacer discs being disposed along each drive shaft and between each said cutting disc, said spacer discs being mounted on said drive shafts such that they rotate in the same direction as the rotation of the drive shaft upon which the spacer discs are mounted;

E. a series of stripper blades, each said stripper blade comprising a solid, unitary essentially flat body having a flat top, an outwardly arcuate bottom surface, a front, and an outwardly arcuate back surface contiguous with the arcuate bottom surface, said back surface having an upper portion, said front having an inwardly arcuate surface intended to extend around the circular spacer in an arc of at least 190 degrees to an arc of not greater than about 260 degrees, said arcuate surface having a lower leading edge and an upper trailing edge, said leading edge and said trailing edge being cutting edges; said outwardly arcuate back surface having a support projection protruding from said upper portion, each such stripper blade being mounted between the cutter discs such that the front inwardly arcuate surface rests on a spacer disc, and the support projection of each stripper blade rests on a supporting edge provided by the lower casing;

the drive shafts being peripherally, dynamically sealed at their ends;

the upper casing and the lower casing having a sealing capability, each with the other at their mating interfaces, and around the carrying cartridge assembly of each of the drive shafts.

2. A stripper blade, said blade comprising a solid, unitary essentially flat body having a flat top, an outwardly arcuate bottom surface, a front, and an outwardly arcuate back surface contiguous with the arcuate bottom surface, said back surface having an upper portion, said front having an inwardly arcuate surface intended to extend around a circular spacer in an arc of at least 190 degrees to an arc of not greater than about 260 degrees, said arcuate surface having a lower leading edge and an upper trailing edge, said leading edge and said trailing edge being cutting edges; said outwardly arcuate back surface having a support projection protruding from said upper portion.

3. A shredder, said shredder comprising:

a shredder support stand;

a shredder head mounted on said support stand, said shredder head comprising:

a housing;

two shredding rollers, each comprising a drive shaft rotatably, horizontally mounted in said housing, spaced apart and parallel to each other, wherein one end of each drive shaft extends through a cartridge carrier assembly and outside of the housing, and wherein each drive shaft has a drive end and an idle end, the drive ends each being located on opposite ends of the housing;

a series of spaced, cutter disc blades disposed along each said drive shaft, the rollers cooperating with each other such that each disc blade on one roller is interdigitally spaced between disc blades on the opposing roller to provide shredding interfaces, said cutter discs being mounted on said drive shafts such that they rotate in the same direction as the rotation of the drive shaft upon which the discs are mounted;

the housing defined by an upper and a lower casing:

the lower casing having an interior surface conforming at least to allow the drive shafts and the cutter discs to rotate therein, said lower casing having a discharge opening;

the upper casing having an interior surface conforming at least to allow the drive shafts and the cutter discs to rotate therein, said upper casing having an infeed opening, said upper casing and said lower casing being capable of fitting together to enclose the cutting discs and forming a cutting chamber;

a series of circular spacer discs being disposed along each drive shaft and between each said cutting disc, said spacer discs being mounted on said drive shafts such that they rotate in the same direction as the rotation of the drive shaft upon which the spacer discs are mounted;

a series of stripper blades, each said stripper blade comprising a solid, unitary essentially flat body having a flat top, an outwardly arcuate bottom surface, a front, and an outwardly arcuate back surface contiguous with the arcuate bottom surface, said back surface having an upper portion, said front having an inwardly arcuate surface intended to extend around the circular spacer in an arc of at least 190 degrees to an arc of not greater than about 260 degrees, said arcuate surface having a lower leading edge and an upper trailing edge, said leading edge and said trailing edge being cutting edges; said outwardly arcuate back surface having a support projection protruding from said upper portion, each such stripper blade being mounted between the cutter discs such that the front inwardly arcuate surface rests on a spacer disc, and the support projection of each stripper blade rests on a supporting edge provided by the lower casing;

the drive shafts being peripherally, dynamically sealed at their ends;

the upper casing and the lower casing having a sealing capability, each with the other at their mating interfaces, and around the carrying cartridge assembly of each of the drive shafts;

a motor assembly mounted on each end of the housing and at the drive end of the drive shaft, each motor assembly having a torque arm assembly cooperating with the motor assembly;

a power source to power and drive each motor independently of the other.

* * * * *